US007810905B2

(12) United States Patent
Miyazaki

(10) Patent No.: US 7,810,905 B2
(45) Date of Patent: Oct. 12, 2010

(54) PRINTING ELEMENT SUBSTRATE SUPPORTING MEMBER, MANUFACTURE METHOD OF PRINTING ELEMENT SUBSTRATE SUPPORTING MEMBER, AND INK JET PRINTING HEAD

(75) Inventor: Hirotaka Miyazaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 532 days.

(21) Appl. No.: 11/951,450

(22) Filed: Dec. 6, 2007

(65) Prior Publication Data

US 2008/0136870 A1 Jun. 12, 2008

(30) Foreign Application Priority Data

Dec. 11, 2006 (JP) ..... 2006-333203
Nov. 21, 2007 (JP) ..... 2007-301396

(51) Int. Cl.
*B41J 2/14* (2006.01)

(52) U.S. Cl. ..... 347/47

(58) Field of Classification Search ..... 347/47
See application file for complete search history.

(56) References Cited

U.S. PATENT DOCUMENTS

| | | | | |
|---|---|---|---|---|
| 6,659,591 | B2 * | 12/2003 | Sato et al. | 347/50 |
| 2005/0078143 | A1 * | 4/2005 | Shimomura et al. | 347/20 |
| 2007/0008378 | A1 * | 1/2007 | Kanda | 347/54 |
| 2008/0136880 | A1 | 6/2008 | Tajima | 347/87 |

* cited by examiner

*Primary Examiner*—Uyen-Chau N Le
*Assistant Examiner*—Hoang Tran
(74) *Attorney, Agent, or Firm*—Fitzpatrick, Cella, Harper & Scinto

(57) ABSTRACT

It is an objective of the present invention to provide a printing element substrate supporting member made of resin material by which, without changing the inclusion rate of filler in the resin material, the linear expansion coefficient can be reduced, the deformation under a heating environment can be suppressed, and the printing element substrate can be suppressed from being peeled or broken. Thus, the printing element substrate supporting member of the present invention is formed by resin material including fibrous filler and has a supporting section for supporting a printing element substrate in which ejecting orifices capable of ejecting ink are arranged. This supporting section is structured so that the filler is oriented along the direction along which the plurality of ejecting orifices are arranged.

9 Claims, 16 Drawing Sheets

PRINTING ELEMENT SUBSTRATE SUPPORTING MEMBER, MANUFACTURE METHOD OF PRINTING ELEMENT SUBSTRATE SUPPORTING MEMBER, AND INK JET PRINTING HEAD

BACKGROUND OF THE INVENTION

1. Field of the Invention

The present invention relates to an ink jet printing head provided in an ink jet printing apparatus for ejecting liquid (e.g., ink) to perform a printing operation. In particular, the present invention relates to a printing element substrate provided in the ink jet printing head and the manufacture method thereof.

2. Description of the Related Art

Conventional printing head 1000 shown in FIG. 15 includes: a printing element unit H1002; and an ink supply unit H1003. The printing element unit H1002 includes: a first printing element substrate H1101, a second printing element substrate H1100, a printing element substrate supporting plate H1200, an electric wiring substrate H1300, an electric contact substrate H2200, and an electric wiring member supporting plate H1400 or the like. The ink supply unit H1003 includes: an ink supply member H1500, a flow path formation member H1600, a joint seal member H2300, a filter H1700, and a seal rubber H1800, or the like. The printing element substrate supporting plate H1200 includes one ink supply path through which the ink is applied to the first printing element substrate H1101 and plurality of ink supply paths through which the ink is applied to the second printing element substrate H1100. Each of these ink paths extend along a direction along which the plurality of ink ejecting orifices formed in each of the printing element substrates H1100 and H1101 is arranged.

The printing element substrates of printing head H1000 is assembled thorough steps as described below. First, an electric wiring member supporting plate H1400 is fixedly adhered to a printing element substrate supporting plate H1200 and a first printing element substrate H1101 and a second printing element substrate H1100 are fixed to the printing element substrate supporting plate H1200 by electric wiring substrate adhesive agent. Then, electric wiring substrate adhesive agent for fixedly adhering a back face of the electric wiring substrate supporting plate H1400 is applied on the electric wiring substrate supporting plate H1400 to fixedly adhere an electric wiring substrate H1300.

As shown in FIG. 16, the above printing head H1000 is attached to a tank holder H2000 that retains an ink tank in a detachable manner, and thereby a cartridge is formed that is provided in a carriage of an ink eject printing apparatus in a detachable manner.

By the way, current ink jet printing apparatuses have another important objective of providing a low-cost ink jet printing head in addition to providing the high quality color printing equal to or higher than that by silver halide photography with a high speed. Means for achieving this objective include the printing element substrate supporting plate H1200 and the electric wiring substrate supporting plate H1400 made of resin. The current printing element substrate supporting plate H1200 and electric wiring substrate supporting plate H1400 are formed by subjecting alumina ($Al_2O_3$) material to a press working and a cutting work. This causes high cost plates to cause higher cost of the resultant ink jet printing head. Thus, a resin-made printing element substrate supporting member has been tried in which the printing element substrate supporting plate H1200 is integrated with the electric wiring substrate supporting plate H1400.

The resin-made printing element substrate supporting member can be manufactured by an injection molding. Thus, the time required for the manufacture can be reduced, providing advantages of the contribution to a low-cost ink jet printing head and a higher design freedom of the shape of the member. However, resin material used for a printing element supporting member has a higher linear expansion coefficient than that of alumina. Thus, a risk is caused where a defect may be caused by the manufacture or other heating environment. For example, in the above-described assembly step of the printing head H1000, the sealant of an electric joint section cures when being heated. Thus, the sealant cures while causing the printing element substrate supporting member to have a higher temperature. Furthermore, the printing element substrate supporting member also has a different temperature due to heat generated from a printing element substrate during the operation of the ink jet printing apparatus or a change in the environment in which the ink jet printing apparatus is operated. Thus, when the printing element substrate supporting member has a high linear expansion coefficient, the deformation amount of the printing element substrate supporting member more is increased, causing a possibility where the printing element substrate may be peeled from the printing element substrate supporting member or the printing element substrate itself is destroyed.

In order to solve the problems as described above, a conventional approach has used resin material for forming a printing element substrate supporting member that includes filler with a higher rate than that of generally commercially available resin material.

However, the high speed printing by ink jet printing apparatuses in recent years causes a trend of a further increasing number of ejecting orifices to cause a proportional increase in the size of a printing element substrate in a direction along which the ejecting orifices are arranged. Thus, further reduction of a linear expansion coefficient of resin material has been required. Resin material including filler with a higher rate tends to have a smaller linear expansion coefficient. However, resin used for a printing element substrate supporting member already includes filler in a higher amount than that of filler included in generally commercially available resin material. Thus, an increase in the amount of filler included in such resin is limited in consideration of molding conditions. Thus, it has been required to reduce the linear expansion coefficient of printing element substrate supporting sections in the printing element substrate supporting member without changing an inclusion rate of filler included in the resin material. The linear expansion coefficient of the printing element substrate can be reduced by uniforming an orientation direction of the filler included in resin material. The filler orientation directions tend to be oriented to a direction along which the resin material flows. In an injection molding of the printing element supporting plate H1200, the resin material which forms areas between the ink supplying paths for supplying color ink flows along the direction along which the ink supply paths extend. According to the flowing of the resin material, the filler included in the resin material in the area tends to be oriented along the direction along which the ink supplying paths extend. As a result, the linear expansion coefficient of the resin material in the areas between the ink supplying paths become relatively lower than that of an areas other than the areas between the ink supplying paths. However, resin flowing direction in areas near ends of the ink supplying paths is not uniformed, and thereby orientation direction of filler included in the resin in the area near the ends of the ink supplying paths is not uniformed. As a result, the linear expansion coefficient of resin in the area near the ends of the ink supplying paths for supplying color ink becomes relatively lower than that of the other area. Further, in the area around the one ink supplying path for supplying black ink, the orientation direction of the filler included in the resin tends not to be uniformed. Accordingly, the linear expansion coefficient of resin in the area near the one ink supplying path becomes relatively higher. It is therefore required to provide the printing element supporting substrate in which filler orientation direction in the printing element supporting section in the printing element substrate is uniformed.

SUMMARY OF THE INVENTION

It is an objective of the present invention to provide a printing element substrate supporting member by which the deformation under a heating environment can be reduced and the printing element substrate can be prevented from being peeled and the printing element substrate can be suppressed from being broken, the manufacture method thereof, and an ink jet printing head.

In order to achieve the above objective, the present invention has a structure as described below.

The first aspect of the present invention is a printing element substrate supporting member having a supporting section for supporting a printing element substrate in which ejecting orifices capable of ejecting ink are arranged. The printing element substrate supporting member is formed by resin material including fibrous filler and at least the supporting section for supporting the printing element substrate has filler oriented in a direction along which the plurality of ejecting orifices are arranged.

The second aspect of the present invention is a method for manufacturing a printing element substrate supporting member having a supporting section for supporting a printing element substrate in which ejecting orifices capable of ejecting ink are arranged by injecting resin material including fibrous filler into a cavity of a forming die. A direction along which the resin material flowing in a region forming the supporting section in the cavity of the forming die flows is limited to the direction along which the plurality of ejecting orifices are arranged.

The third aspect of the present invention is a printing element substrate in which ejecting orifices capable of ejecting ink are arranged is supported by the printing element substrate supporting member according to any of the above.

In the ink jet printing head according to the present invention, a part of the printing element substrate supporting member adhered to the printing element substrate has filler oriented in a direction along which the ejecting orifices are arranged. Thus, even when inclusion rate of filler of resin material constituting the printing element substrate supporting member is in the same amount as that of a conventional resin-made printing element substrate supporting member, the printing element substrate supporting member has a linear expansion coefficient in the direction along which the ejecting orifices are arranged that is lower than that in a conventional design. As a result, the printing element substrate supporting member can be suppressed from being deformed due to heat caused in a head assembly step or heat caused in an operation of an ink jet printing apparatus for example. Thus, a printing element substrate can be suppressed from being peeled from the printing element substrate supporting member and a printing element substrate can be suppressed from being broken for example.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings.

First Embodiment

Figure 15:
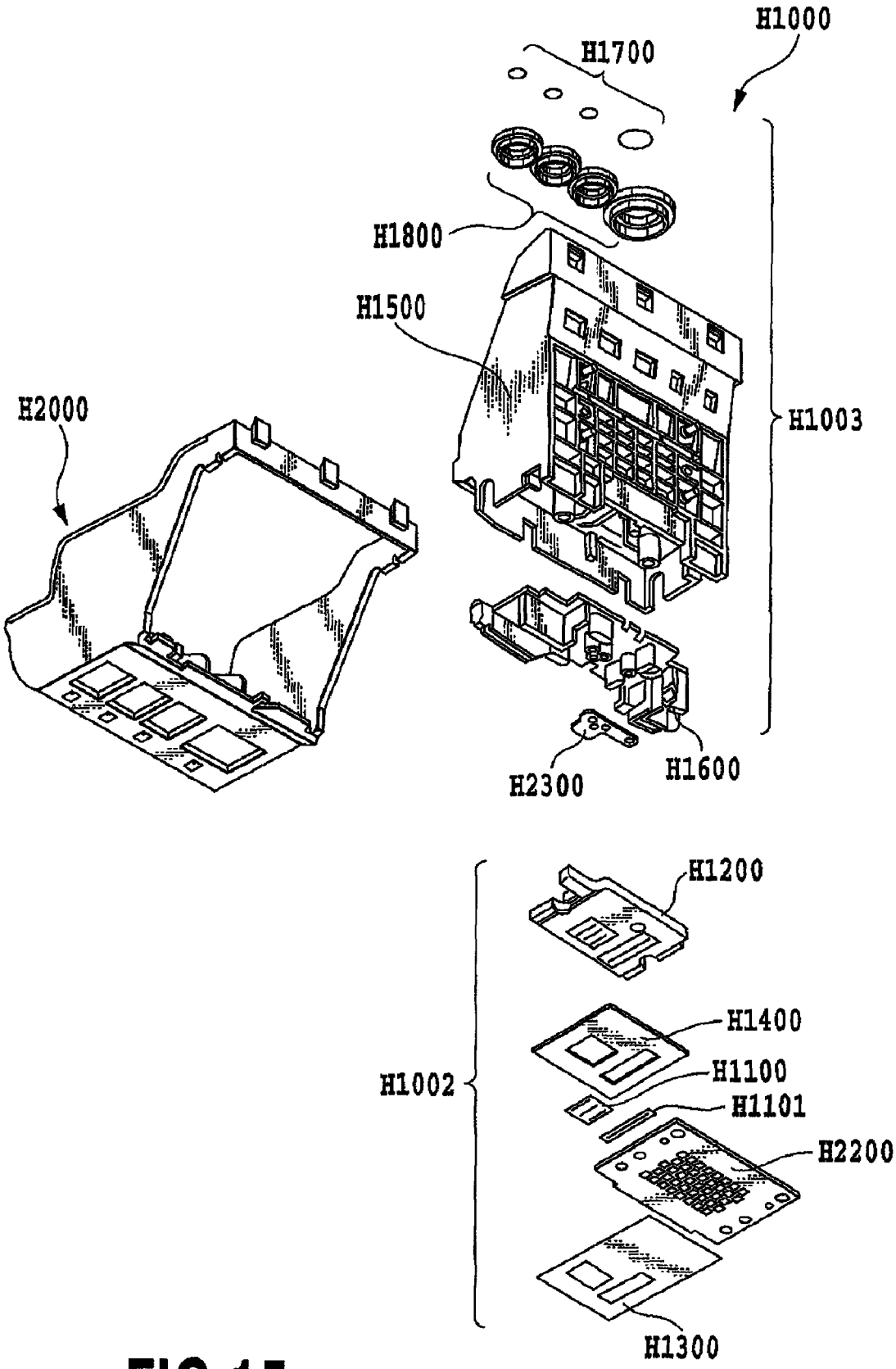
FIG. 15 is an expanded perspective view illustrating an example of the structure of a conventional printing head.
Figure 16:
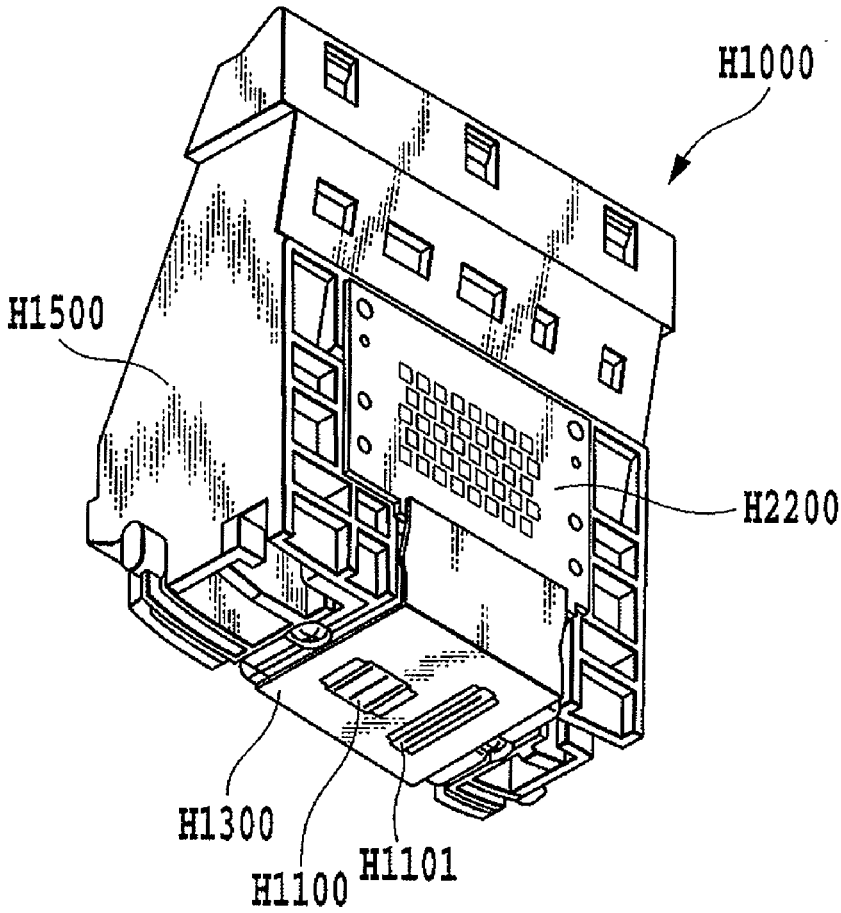
FIG. 16 is a perspective view illustrating the appearance of the printing head shown in FIG. 15 after the assembly.

An ink jet printing head in the first embodiment of the present invention includes, as in those shown in FIG. 15 and FIG. 16, the printing element unit H1002 that can eject ink and the ink supply unit H1003. The ink supply unit H1003 is structured to include, instead of the printing element substrate supporting plate H1200 and the electric wiring member supporting plate H1400 shown in FIG. 15, the electric substrate supporting member H3000 shown in FIG. 1 or FIG. 3. In this point, the printing head in the first embodiment is different from the printing head shown in FIG. 15. The other structures of the printing element unit and the ink supply unit are basically the same as those shown in FIG. 15 except for the number of colors of inks.

Figure 1:
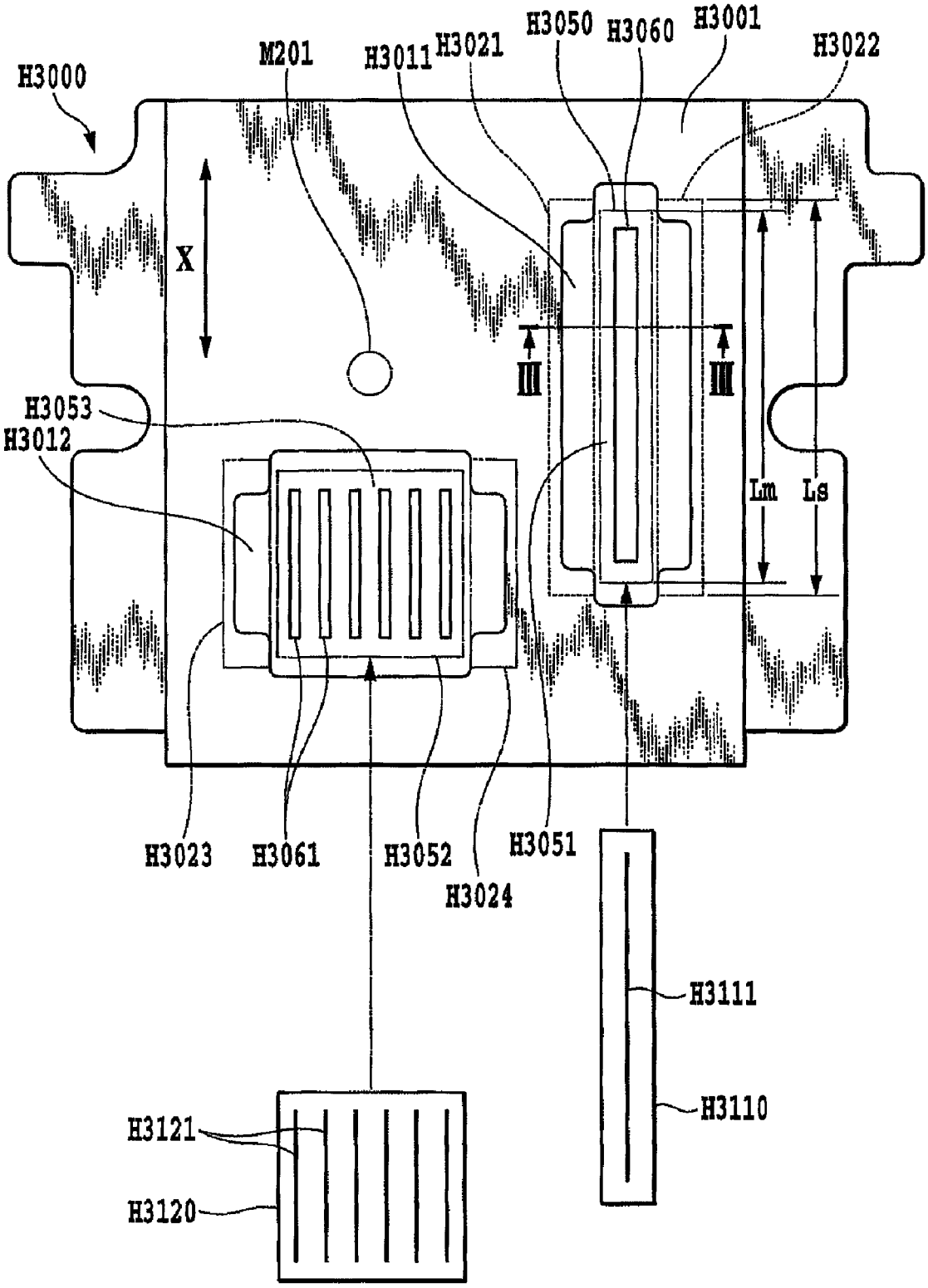
FIG. 1 is a plan view illustrating a printing element substrate supporting member in the first embodiment of the present invention.
Figure 2:
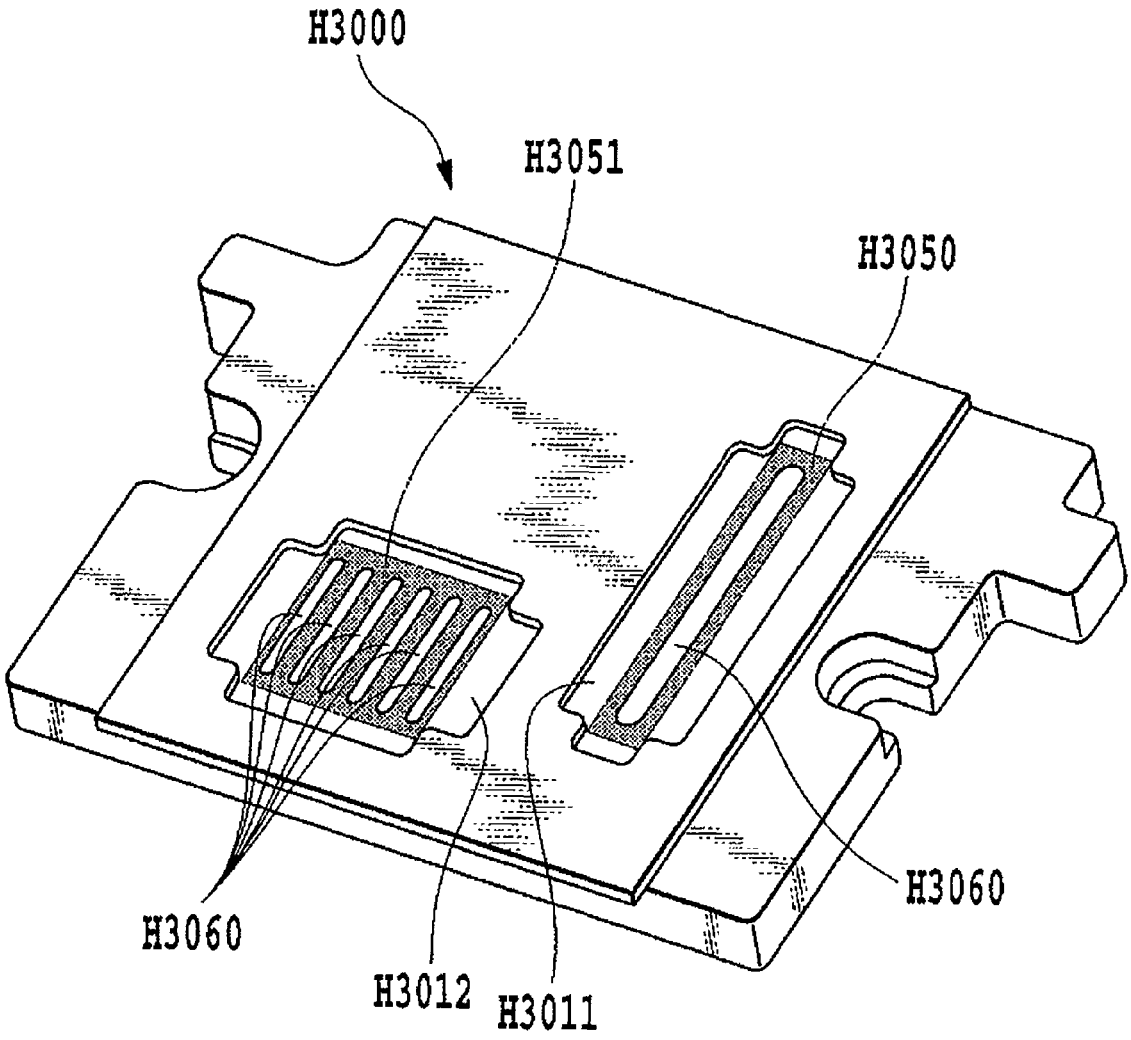
FIG. 2 is a perspective view illustrating the appearance of the printing element substrate supporting member shown in FIG. 1.
Figure 3:
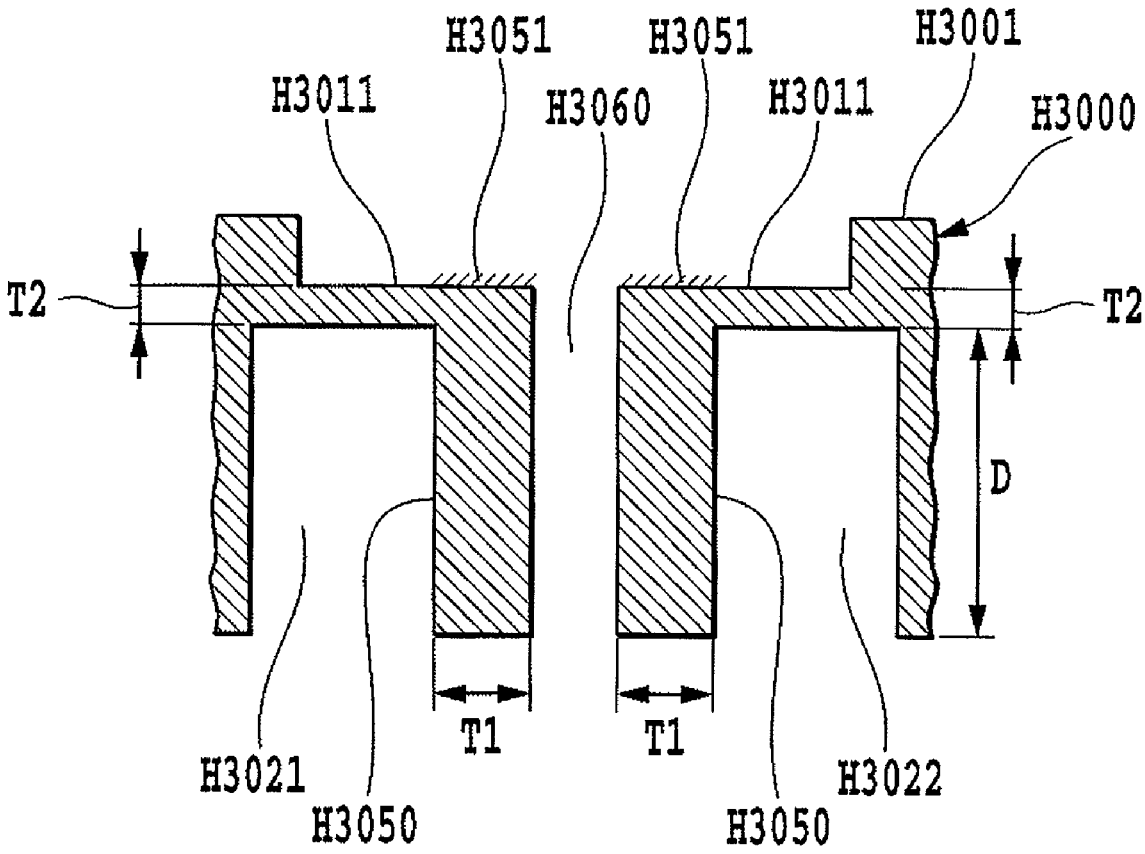
FIG. 3 is across-sectional view taken along III-III of the printing element substrate supporting member shown in FIG. 1.

Next, the following section will describe the structure of the printing element substrate supporting member H3000 used for the ink jet printing head in the first embodiment. FIG. 1 is a plan view illustrating the printing element substrate supporting member. FIG. 2 is a perspective view illustrating the appearance of the printing element substrate supporting member H3000. FIG. 3 is a cross-sectional view of the printing element substrate supporting member taken along the III-III.

In the respective drawings, the printing element substrate supporting member H3000 is structured by a single resin member formed by a manufacture method (which will be described later). The printing element substrate supporting member H3000 includes an electric wiring member supporting member H3001 and two printing element substrate supporting faces H3011 and H3012. One printing element substrate supporting face H3011 has one ink supply path 3060. A periphery H3050 of this ink supply path 3060 (a part surrounded by the dotted line in the drawing) functions as a supporting section in which an adhesion face H3051 is formed to fixedly adhere a printing element substrate H3110 having a printing element array H3111 by using adhesive agent. A direction along which a plurality of ejecting orifices of the printing element substrate H3110 adhered to this adhesion face H3051 are arranged (i.e., the longitudinal direction of the ink ejecting orifice array H3111 (direction X) is identical with the longitudinal direction of the ink flow path H3060. The other printing element substrate supporting face H3012 includes an ink supply path group consisting of six ink supply paths H3060. This ink supply path group is surrounded by a H3052 (a part surrounded by the dotted line in the drawing) functions as a supporting section having an adhesion face H3053 in which the printing element substrate H3120 including the six ejecting orifice arrays H3121 is fixedly adhered. A direction along which the ejecting orifices of the printing element substrate H3120 fixedly adhered to the supporting section H3052 are arranged (i.e., the longitudinal direction of the ejecting orifice array H3121 (direction X)) is identical with the longitudinal direction of the ink supply path H3061.

The respective ink ejecting orifices constituting the respective ink ejecting orifice arrays H3111 and 3121 of the respective printing element substrates H3110 and H3120 communicate with the respective ink flow paths in the printing head. The respective ink flow paths communicate with the common liquid chamber in the printing head. An ink supply opening formed in this common liquid chamber communicates with the ink supply path H3060 of each printing element substrate H3120. As a result, ink flowing from the ink supply unit H1003 to the ink supply path H3060 further flows through the ink supply opening of the common liquid chamber formed in the printing element substrate H3120 to allow ink to be filled in each ink flow path.

The back face of the printing element substrate supporting member H3000 (i.e., the opposite side of the printing element substrate supporting face H3011) has a pair of concave sections H3021 and H3022 (filler orientation direction control shape section) extending in the direction along which the ejecting orifices of the adhesion region H3050 are arranged (direction X). The concave sections H3021 and H3022 function as a filler orientation direction control section by which the orientation direction of the filler included in the resin material forming the printing element adhesion region H3050 positioned at the inner side are aligned, in an injection molding step (which will be described later), in predetermined direction along an ejecting orifice arrangement direction. "The predetermined direction along the ejecting orifice arrangement direction" includes not only the direction which is parallel to the ejecting orifice arrangement direction but also directions which are not parallel to the ejecting orifice arrangement direction. However, it is more desirable that the predetermined direction is parallel to the ejection orifice arrangement direction.

The following section will describe an example of the sizes of the respective parts of the printing element substrate supporting member H3000 in the first embodiment.

In FIG. 1 to FIG. 3, the concave sections H3021 and H3022 having a concave cross section that function as the filler orientation direction control shape section as a depth D of 3 mm. The respective filler orientation direction control shape sections H3021 and H3022 and the ink supply path H3060 have therebetween a thickness T1 of 1 mm. The respective filler orientation direction control shape sections H3021 and H3022 and the printing element substrate supporting face H3011 have therebetween a thickness T2 that is thinner than the thickness T1 between the respective filler orientation direction control shape sections H3021 and H3022 and the ink supply path H3060. Here, the thickness T2 is 0.5 mm. The filler orientation direction control shape section H3022 in the ejecting orifice arrangement direction (direction X) has a length Ls designed to protrude from the respective ends of the supporting section H3050 by 0.5 mm. Specifically, the length Ls in the direction X of the filler orientation direction control shape section H3022 is longer than the length Lm of the supporting section H3050 by 1 mm.

Resin material used is prepared by adding about 60% of filler by a weight ratio to polyphenylene sulfide (PPS) as base resin (fibrous filler is about 20%). However, base resin of resin material may be any material so long as the material has favorable chemical resistance (e.g., polyethylene terephthalate (PET), polyphenylene ether (PPE), polyether sulphone (PES)).

Figure 4:
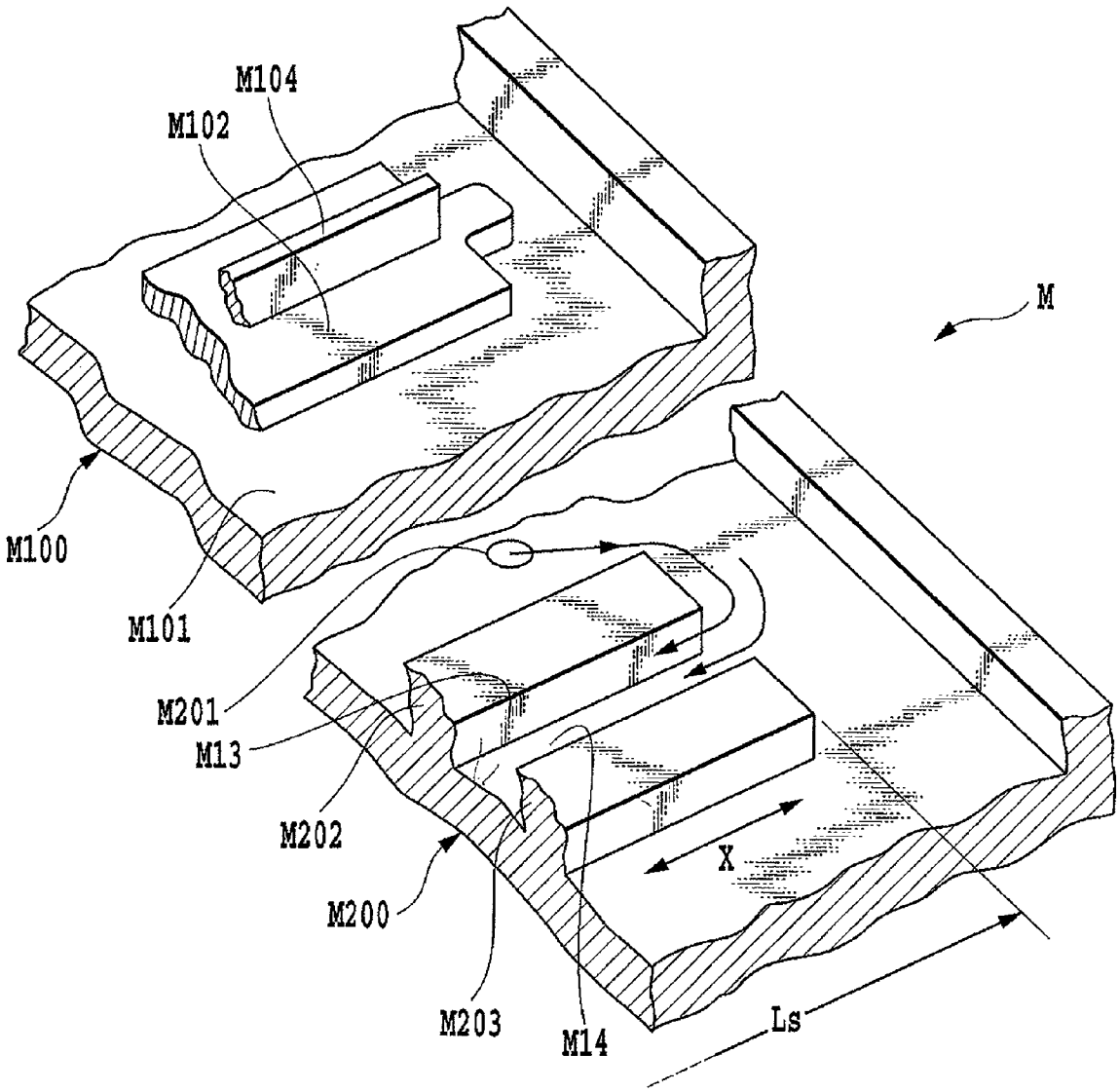
FIG. 4 is a perspective view illustrating a part of a forming die used in the first embodiment.
Figure 5:
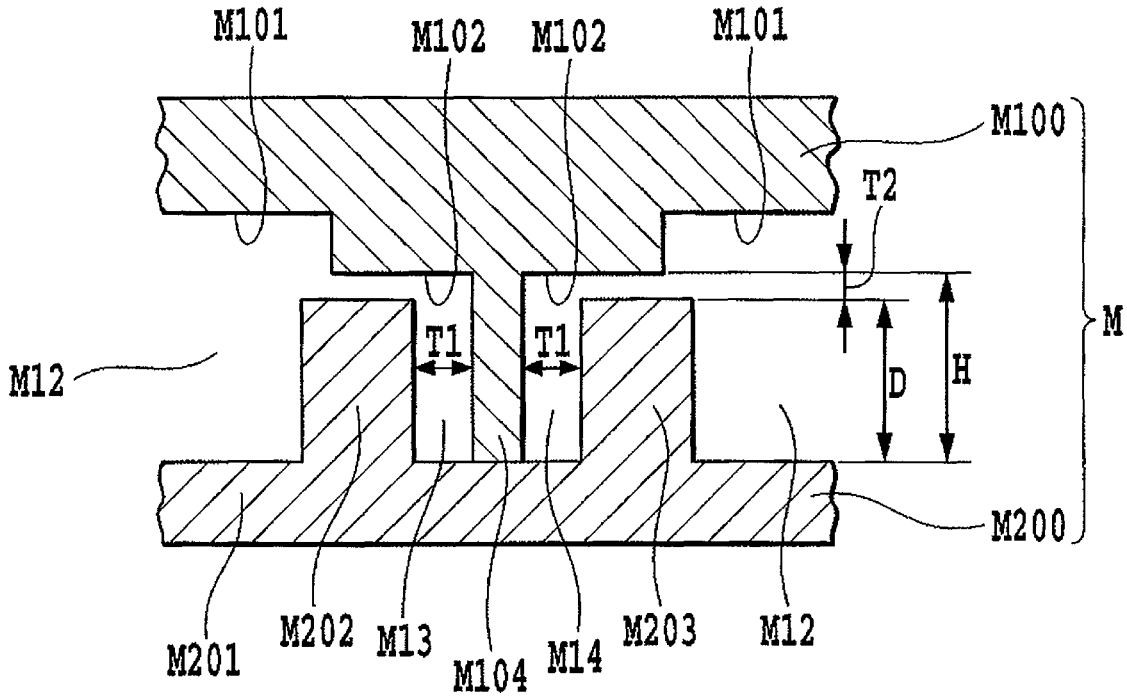
FIG. 5 is a cross-sectional view showing a part of the forming die shown in FIG. 4.

Next, the manufacture method of the printing element substrate supporting member H3000 having the above structure will be described. In the first embodiment, resin material including filler as described above is subjected to an injection molding to manufacture the printing element substrate supporting member H3000. FIG. 4 is a perspective view illustrating a part of a forming die used in this injection molding method. FIG. 5 is a cross-sectional view illustrating a part of a forming die M used in this injection molding.

The periphery of the supporting section in the printing element substrate supporting member H3000 adhered with the printing element substrate H3110 is formed by a part of the forming die M as shown in FIG. 4 and FIG. 5. The shown forming die M consists of an upper mold M100 and a lower mold M200. The lower mold M200 has a gate M201 to inject the above-described resin including filler into a cavity formed by both of the molds. The lower mold M200 has a pair of concave sections of the back face of the above-described printing element substrate supporting member H3000 (i.e., a pair of convex sections M202 and M 203 for forming the filler orientation direction control shapes H3021 and H3022). The convex sections M202 and M203 extend in the direction along which the ejecting orifices are arranged (direction X). The convex sections M202 and M203 have a rectangular cross sectional shape as shown in FIG. 5. The convex sections M202 and M203 have a length Ls and a height D (3 mm) in the direction X.

On the other hand, the lower face of the upper mold M1100 has, as shown in FIG. 5, a formation face M101 for forming the electric wiring substrate supporting face H3001 of the printing element substrate supporting member H3000 and a formation face M102 for forming the printing element substrate supporting face H3011. The formation face M102 protrudes from the formation face M101 in the lower direction. The center of the formation face M102 of the upper mold M100 has a protruded stripe section M104 extending in the direction along which the ejecting orifices are arranged (direction X). This protruded stripe section M104 has a rectangular cross section. This protruded stripe section M104 has a length Lm and a height H in the direction X. The height H of this protruded stripe section M104 is set so as to satisfy a relation of (H−D(=T2))<1 mm where (H−D) is 0.5 mm. In the cavity M12 formed by combining the upper mold M100 with the lower mold M200, the protruded stripe section M104 and the respective convex sections M202 and M203 have therebetween regions M13 and M14 having a width T1 (=1 mm).

When the printing element substrate supporting member H3000 is formed, the above-described resin material including filler is injected through the gate M201 formed in the lower mold M200 to fill the resin into the cavity M12 formed between the upper mold M100 and the lower mold M200. Then, the resin material injected through the gate M201 flows as shown by an arrow of FIG. 4. Specifically, the resin material mainly flows from one end of convex sections M202 and M203 having a small flow resistance into the regions M13 and M14 formed between both side faces of the protruded stripe section M104 and the convex sections M202 and M203 opposing to both side faces with a fixed interval. The resin material flowed into the regions M13 and M14 flows in the regions M12 and M13 along the direction X that is a direction along which the ejecting orifices are arranged to reach the convex sections M202 and M203.

By the flow of the resin material in the regions M12 and M13 as described above, fibrous filler included in the resin material are oriented in a direction along which the resin material flows (i.e., a direction along which the ejecting orifices are arranged (direction X)). By the resin material filled in the regions M12 and M13, the supporting section H3050 of the printing element substrate shown in FIG. 1 to FIG. 3 is formed.

As described above, by orienting filler of a resin formation part forming the supporting section H3050 in the direction along which the ejecting orifices are arranged, the supporting section H3050 has a linear expansion coefficient in the direction X that is significantly lower than that when the filler is not oriented in the direction X. Thus, even when heat caused in an assembly step of a printing head, heat generated from the printing element substrate H3110 during a printing operation, or a change in the environment temperature for example causes a change in the temperature of the printing element substrate supporting member H3000, the deformation of the supporting section H3050 is suppressed to a small amount. Thus, a possibility where the printing element substrate H3110 may be peeled from the printing element substrate supporting member H3000 or the printing element substrate H3110 may be destroyed is significantly reduced. Thus, a reliable and durable ink jet printing head can be provided.

Figure 6A:
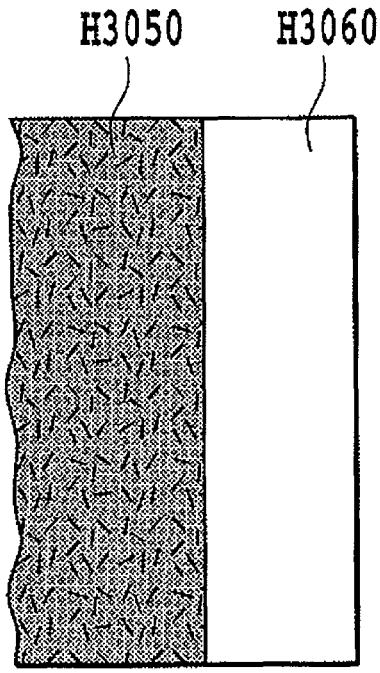
FIG. 6A illustrates a filler orientation status in a supporting section of a printing element substrate and shows a case where a filler orientation direction control shape section is not formed.
Figure 6B:
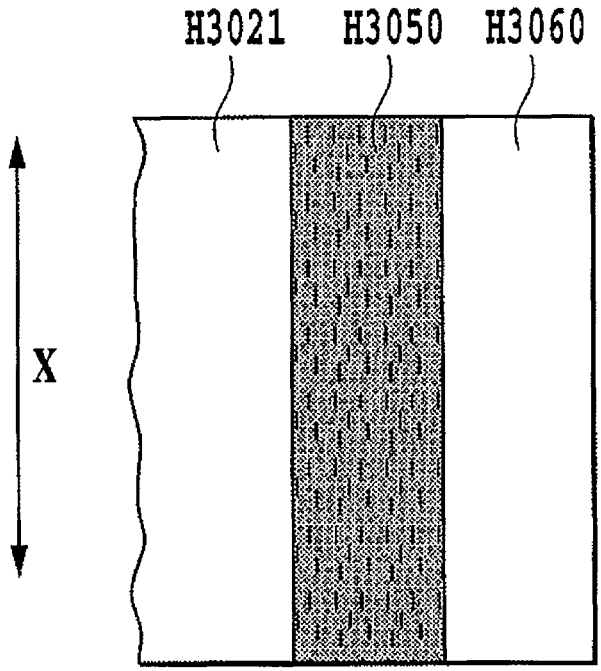
FIG. 6B illustrates a filler orientation status in a supporting section of a printing element substrate and shows a case where the filler orientation direction control shape section is formed.

FIG. 6A and FIG. 6B illustrate filler orientation status in the supporting section H3050 of the printing element substrate H3110. FIG. 6A shows a case where the filler orientation direction control shape section is not formed. FIG. 6B shows a case where the filler orientation direction control shape sections H3021 and H3022 are formed.

When the filler orientation direction control shape section is not formed, filler is oriented, as shown in FIG. 6A, in directions significantly varied in the left and right directions. On the other hand, when the filler orientation direction control shape sections H3021 and H3022 are formed, filler is oriented, as shown in FIG. 6B, almost in a direction along which the ejecting orifices are arranged. A linear expansion coefficient when the filler orientation direction is controlled is a half of that when the filler orientation direction is not controlled.

In the above description, a case was described in which the filler orientation direction control shape section was formed to correspond a printing element substrate adhesion region in which the printing element substrate H3110 is fixedly adhered that is provided by forming ink supply paths in one array. On the other hand, the adhesion region H3051 of the printing element substrate H3120 for fixedly adhering a printing element substrate having six ink supply paths can suppress, without providing the filler orientation direction control shape, the linear expansion coefficient to a relatively small value. The reason is that the respective ink supply paths have thereamong a narrow region of about 1 mm. This region is made of such resin material that flows along the protruded stripe sections provided in the upper mold for forming the respective ink supply paths 3062 so that filler is oriented in a direction along which the ejecting orifices are arranged. However, if a side of the printing element substrate adhesion region H3051 has the filler orientation direction control shape sections H3023 and H3024 like those provided to the printing element substrate adhesion region H3051, the printing element substrate adhesion region H3051 can have a further reduced linear expansion coefficient.

Figure 7A:
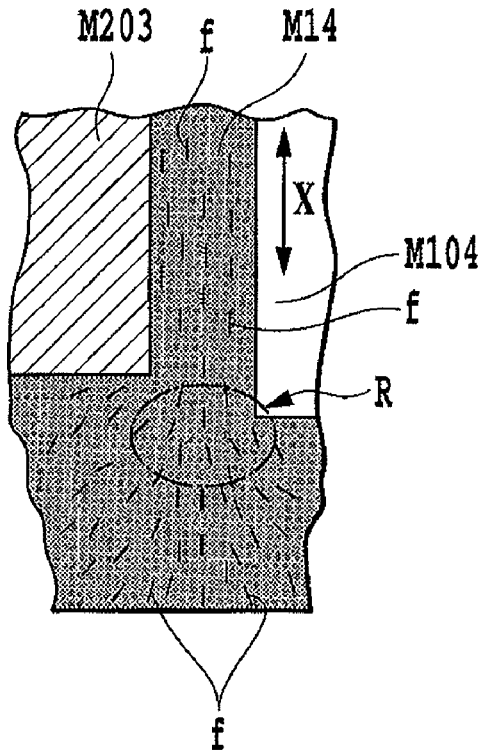
FIG. 7A shows the orientation direction status of filler during the formation and shows a case where the forming die shown in FIG. 4 is used.
Figure 7B:
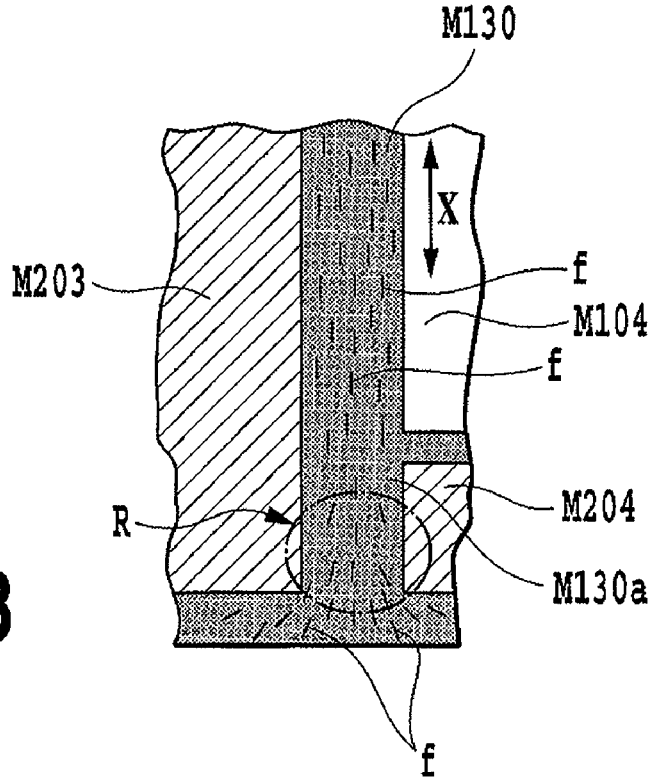
FIG. 7B shows the orientation direction status of filler during the formation and shows a case where the forming die shown in FIG. 8 is used.
Figure 8:
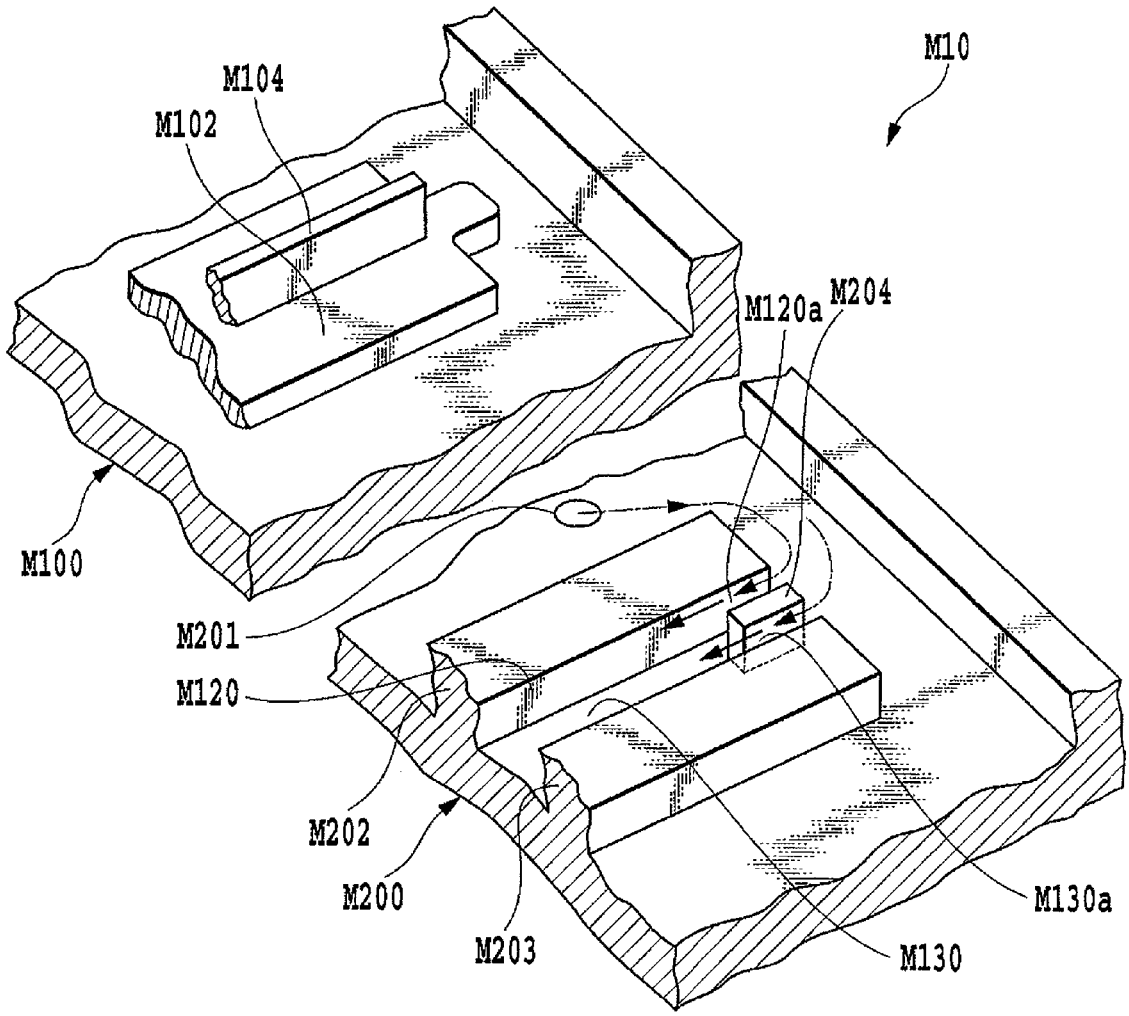
FIG. 8 is a perspective view illustrating a part of another forming die in the first embodiment.
Figure 9:
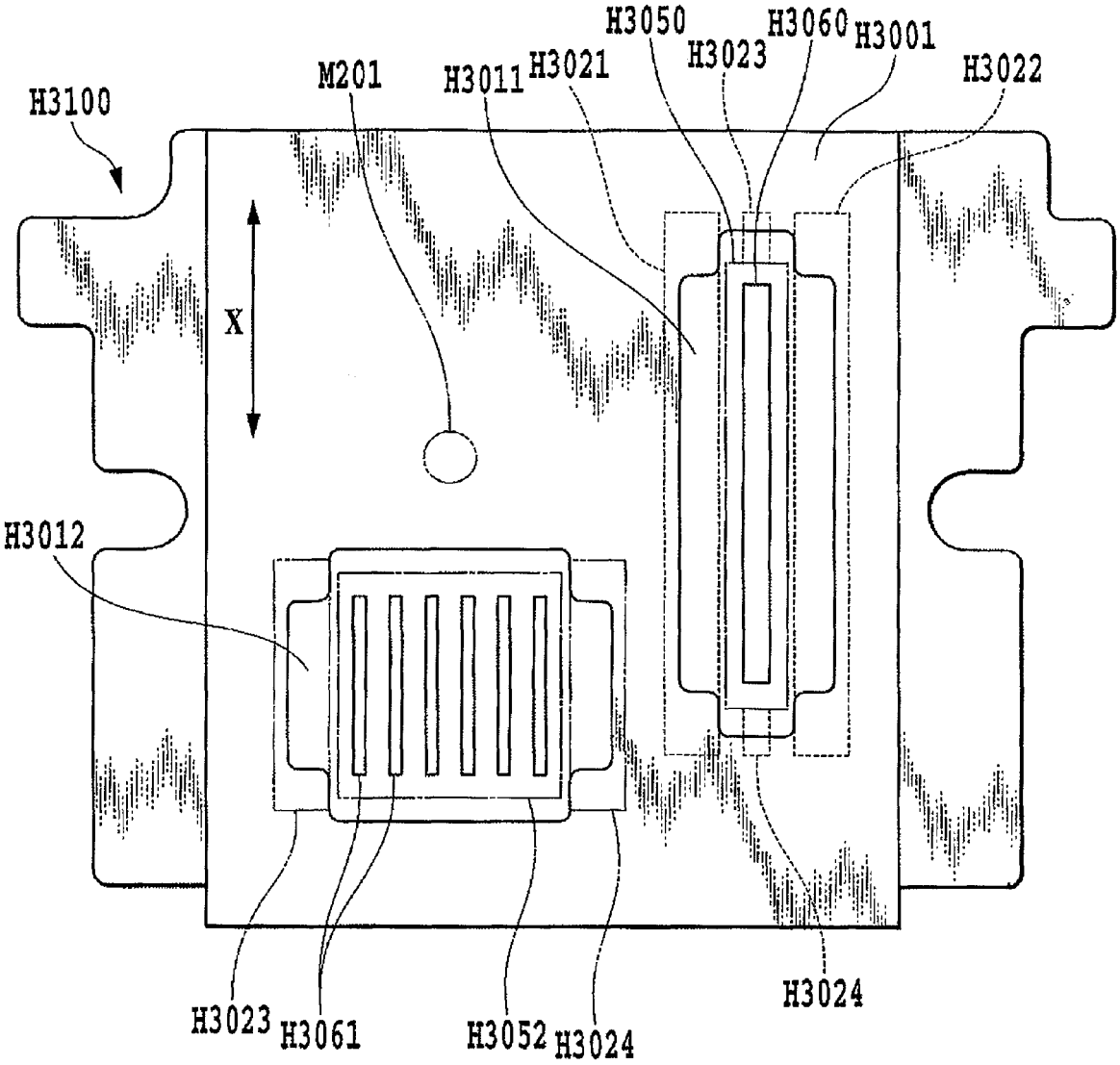
FIG. 9 is a plan view illustrating a printing element substrate supporting member formed by the forming die shown in FIG. 8.

In the above embodiment, when resin material flows into the regions M13 and M14 formed between the protruded stripe section M104 and the convex sections M202 and M203, there may be a case where filler in the region R in the vicinity of the end of the flow of the regions M13 and M14 as shown in FIG. 7A has an unstable orientation direction. In this case, a forming die M10 as shown in FIG. 8 also can be used. This forming die M10 is provided by extending the ends of the pair of convex sections M202 and M203 to exceed the forming die M shown in FIG. 4 to further form the convex sections M204 between the convex sections M202 and M203. According to this forming die M10, the resin material passes the region M120*a* and M130*a* formed among convex sections M202, M203, and M204 so as to allow the filler f to be oriented in the orientation direction as shown in the region R of FIG. 7B and subsequently flows into the regions M120 and M130. Thus, the filler at both ends of the region M120 and M130 is substantially aligned along the even direction while the orientation direction being limited. This further reduces the linear expansion coefficient of the supporting section H3050 (see FIG. 9) formed by the resin material filled into the regions M120 and M130. FIG. 9 is a plan view illustrating the printing element substrate supporting member H3100 formed by the forming die M10 shown in FIG. 8. As shown in the drawing, when the printing element substrate supporting member H3100 is compared with the printing element substrate supporting member H3000 shown in FIG. 1, the concave sections H3021 and H3022 extending in the direction X are formed and the respective ends of the concave sections have thereamong concave sections H3023 and H3024.

Second Embodiment

Figure 10:
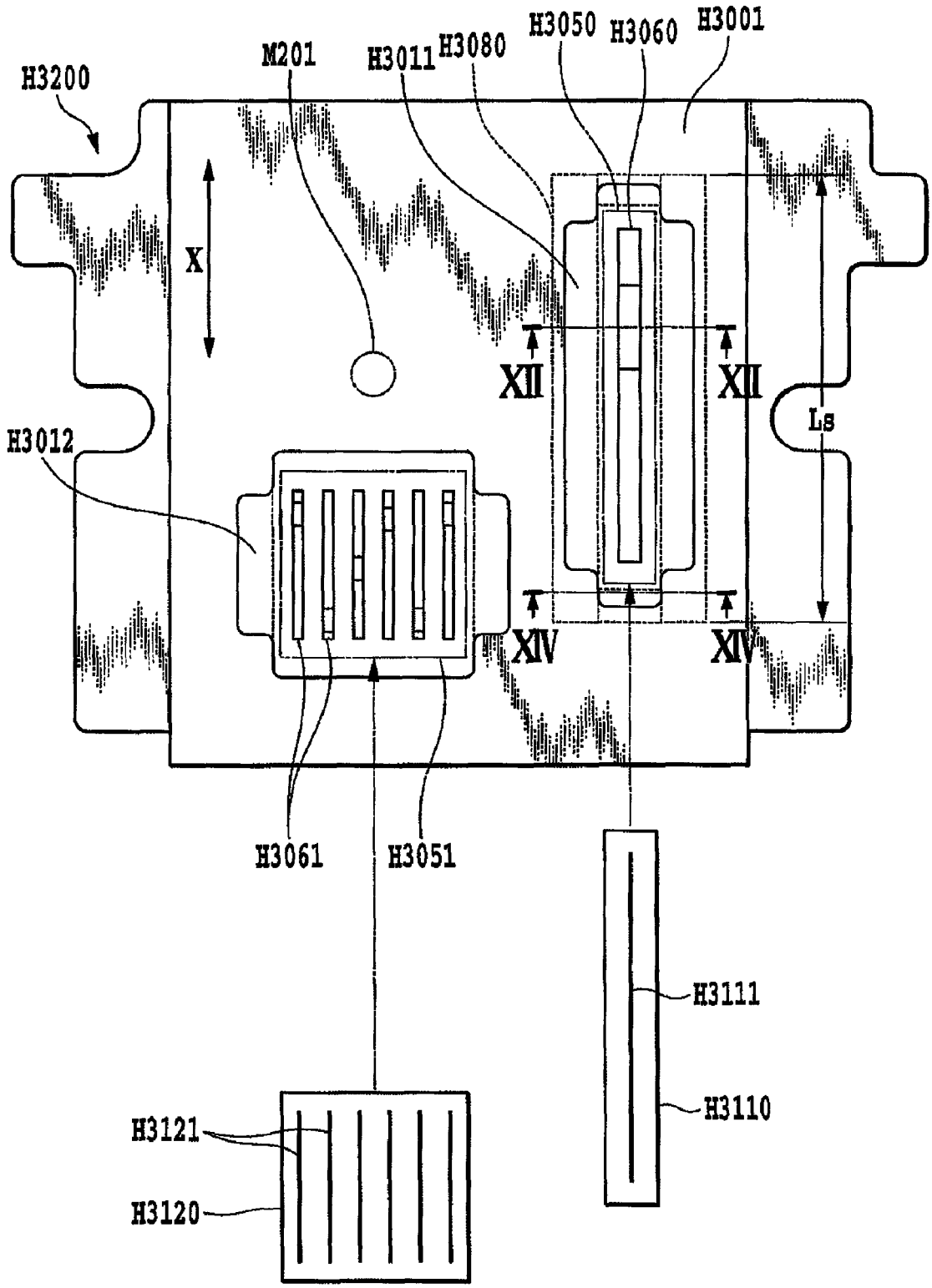
FIG. 10 is a plan view illustrating a printing element substrate supporting member showing the second embodiment of the present invention.
Figure 11:
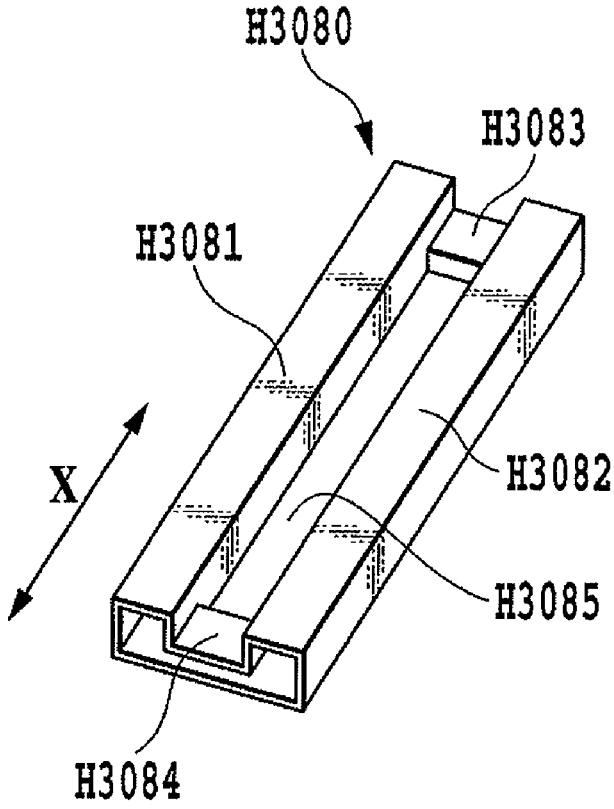
FIG. 11 is a perspective view illustrating the appearance of a filler orientation direction control member insert-molded to the printing element substrate supporting member in the second embodiment.
Figure 12:
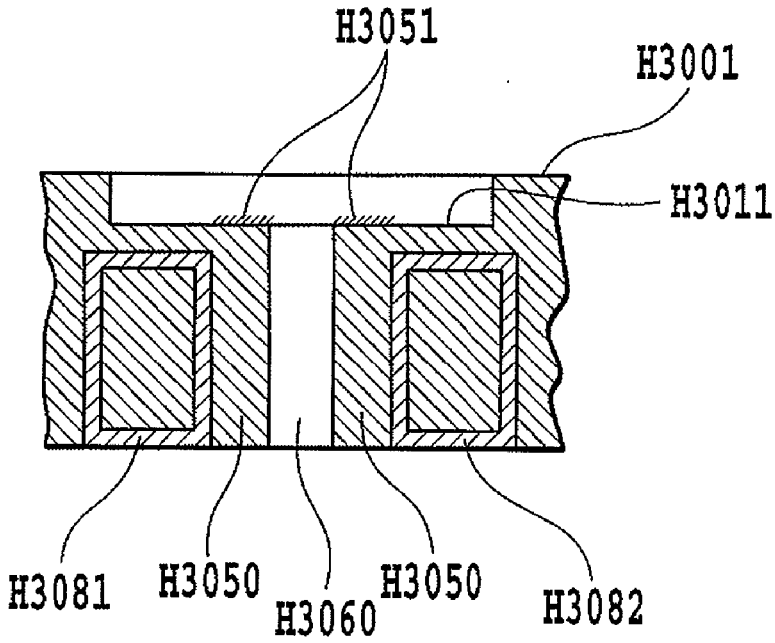
FIG. 12 is a cross-sectional view showing the printing element substrate supporting member shown in FIG. 10 taken along the line XII-XII.
Figure 13:
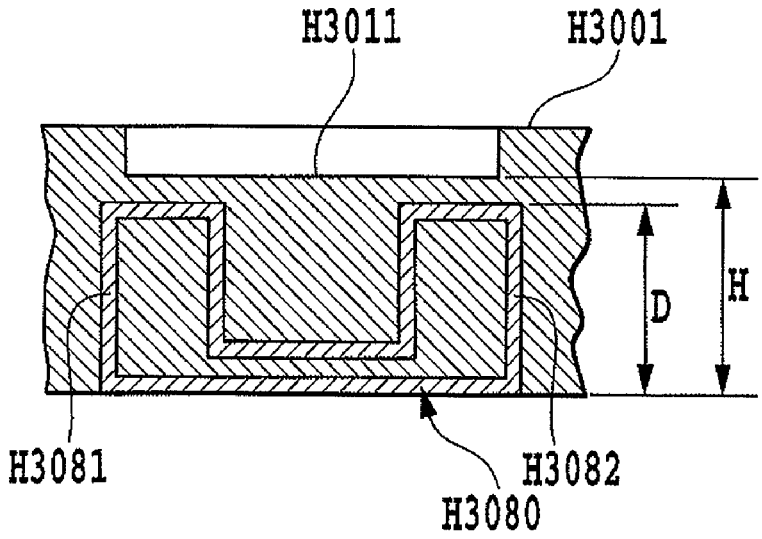
FIG. 13 is a cross-sectional view showing the printing element substrate supporting member shown in FIG. 10 taken along the line XIV-XIV.
Figure 14:
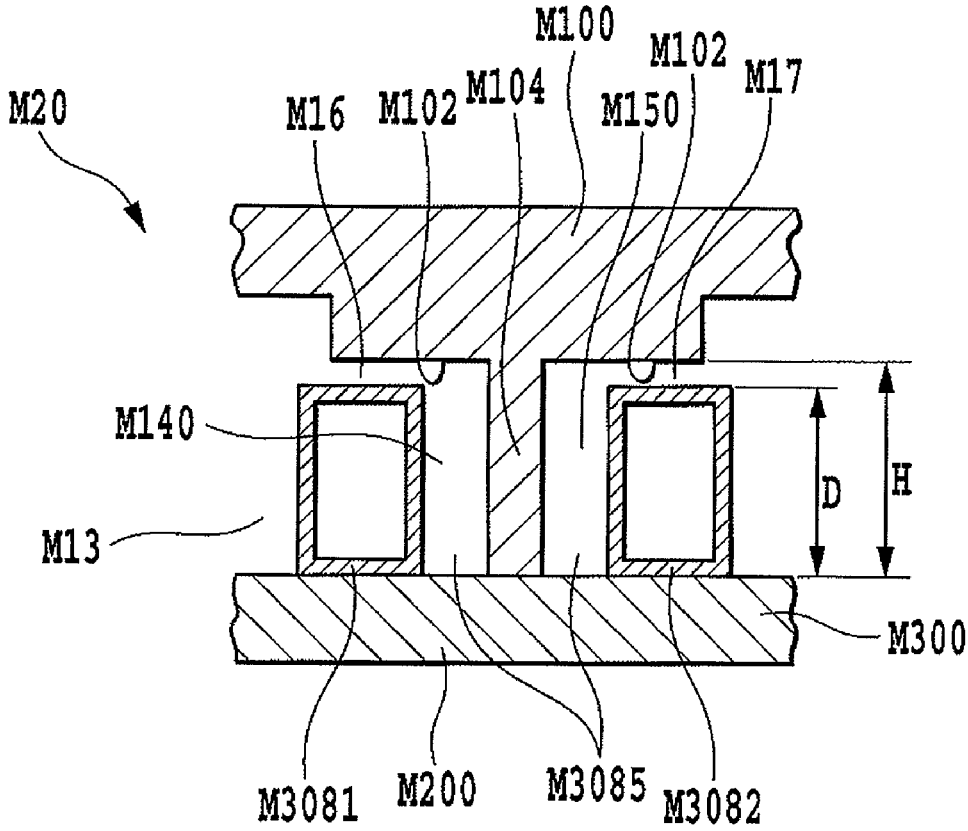
FIG. 14 is a cross-sectional view illustrating a part of a forming die used in the second embodiment.

Next, the second embodiment of the present invention will be described with reference to FIG. 10 to FIG. 14. FIG. 10 is a plan view of a printing element substrate supporting member showing the second embodiment of the present invention. FIG. 11 is a perspective view illustrating the appearance of a filler orientation direction control member for forming the filler control direction control shape section. FIG. 12 is a cross sectional view of the printing element substrate supporting member shown in FIG. 10 taken along the line XII-XII. FIG. 13 is a cross sectional view of the printing element substrate supporting member shown in FIG. 10 taken along the line XIV-XIV. FIG. 14 is a cross-sectional view illustrating a part of a forming die used in the second embodiment of the present invention. In the respective drawings, the same or corresponding components of those of the first embodiment are denoted with the same reference numerals.

The printing element substrate supporting member H3200 shown in the second embodiment includes, as in the first embodiment, an electric wiring member supporting face H3001 and two printing element substrate supporting faces H3011 and H3012. One printing element substrate supporting face H3011 has one ink flow path H3060 while the other printing element substrate supporting face H3012 has an ink flow path group consisting of six ink flow paths H3061. The back face of the printing element substrate supporting face H3011 having one ink flow path is inserted with a filler orientation direction control member H3080 as shown in FIG. 11 in the manner as shown in FIG. 12 and FIG. 13. This filler orientation direction control member H3080 is made of alumina and is composed of a pair of orientation direction control sections H3081 and H3082 and connection sections H3083 and H3084 connecting the pair of orientation direction control sections H3081 and H3082 each other. The orientation direction control sections H3081 and H3082 have a hollow shape having a rectangular cross section and extend in a direction along a direction (direction X) along which ejecting orifices of the printing element substrate H3110 fixedly adhered to the adhesion region H3050 are arranged. The pair of orientation direction control sections H3081 and H3082 and the connection sections H3083 and H3084 form a penetration hole H3085 extending in the direction X. The pair of orientation direction control sections H3081 and H3082 are connected by the connection sections H3083 and H3084. Thus, material can be easily placed in a forming die for an insert molding (which will be described later).

When the printing element substrate supporting member H3200 is formed, the filler orientation control member H3080 is placed on the lower mold M300 so that the protruded stripe section M104 of the upper mold M100 forming the ink flow path H3060 is positioned at the center of the penetration hole H3085 as shown in FIG. 14. The used upper mold M100 is the same as that shown in FIG. 5. The lower mold M300 has a flat face obtained by removing the convex sections M202 from the lower mold M200 shown in FIG. 5. A distance D from the upper face of the lower mold M300 to the upper face of the filler orientation control member H3082 is set as 3 mm. A distance H from the upper face of the lower mold M300 to the formation face M102 of the upper mold of the filler orientation control member H3082 is set to satisfy a relation of $(H-D)<1$ mm where $(H-D)=0.5$ mm. The filler orientation direction control shape has a length Ls in the direction along which the ejecting orifices are arranged. The length Ls protrudes by 2 mm from each end of the printing element substrate supporting section in the direction along which the ejecting orifices are arranged (direction X).

Next, an injection molding step is performed where resin material is injected through a gate (not shown) of the lower mold M300 into the cavity M13 formed by the upper mold M100, the lower mold M300, and the filler orientation control member H3080 to fill the cavity M13. The resin material is composed of base resin of polyphenylene sulfide (PPS) that is added with about 60% of filler by a weight ratio.

In this step of filling the resin material, the resin material flowed into the regions M140 and M150 formed between the protruded stripe section M104 of the upper mold M100 and the orientation direction control sections H3081 and H3082 mainly flows from one end of the orientation direction control sections H3081 and H3082 having a small flow resistance. Then, the resin material flowed into the regions M140 and M150 flows in the direction X to reach the other ends of the orientation direction control sections H3081 and H3082 and then the resin material is filled in the regions M140 and M150. Then, the orientation direction of the filler of the resin material filled in the regions M140 and M150 was checked. The result was that the second embodiment showed the same filler orientation of as that in the first embodiment. Specifically, it was confirmed that fibrous filler included in resin material was oriented in the direction X (which is a direction orthogonal to the paper of FIG. 14). A part formed by the region material filled in the regions M140 and M150 functions as a supporting section of the printing element substrate h3110 and the upper face thereof functions as the adhesion face H3051.

Thus, in the second embodiment, the linear expansion coefficient of the printing element substrate adhesion region H3050 in the direction X is significantly reduced when compared with a case where the filler is not oriented in the direction X. Thus, even when heat caused in an assembly step of a printing head, heat generated from the printing element substrate during a printing operation, or a change in the environment for example causes a change in the temperature of the printing element substrate supporting member, the deformation of the printing element substrate adhesion region is suppressed to a small amount. As a result, a possibility where the printing element substrate H3110 may be peeled from the printing element substrate supporting member H3000 or the printing element substrate may be destroyed is significantly reduced. Thus, a reliable and durable ink jet printing head can be provided.

In the second embodiment, the filler orientation direction control member was made of alumina. However, the filler orientation direction control member may be made of any material so long as the material has a favorable linear expansion coefficient.

In the second embodiment, the filler orientation direction control member H3082 was inserted (or insert-molded) to the printing element substrate supporting member to form the filler orientation direction control shape. However, the filler orientation direction control member H3082 also can be formed by two-color molding. Specifically, the first formation step uses the lower mold M200 shown in FIG. 4 and an upper mold (not shown) corresponding to the lower mold M200 to form a filler orientation control section (molded component) having the same shape as that of the filler orientation direction control member H3082. Next, the second formation step uses, instead of the upper mold used in the first formation step, the upper mold M100 as shown in FIG. 4 to form the electric wiring substrate supporting face H3001 and the printing element substrate supporting faces H3011 and H3012 in the filler orientation control section formed in the first formation step. In this manner, as in the second embodiment, a printing element substrate supporting member can be formed in which the printing element substrate supporting section has a reduced linear expansion coefficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-333203, filed Dec. 11, 2006 and 2007-301396, filed Nov. 21, 2007, which are hereby incorporated by reference herein in their entirety.

What is claimed is:

1. A printing element substrate supporting member having a supporting section for supporting a printing element substrate in which ejecting orifices capable of ejecting ink are arranged, wherein the printing element substrate supporting member is formed by resin material including fibrous filler and at least the supporting section for supporting the printing element substrate has filler oriented in a direction along a direction along which the plurality of ejecting orifices are arranged, and the printing element substrate supporting member is formed by resin material including fibrous filler by an injection molding method and a side of the supporting section for supporting the printing element substrate has a filler orientation direction control shape section that extends in the direction along which the ejecting orifices are arranged.

2. The printing element substrate supporting member according to claim 1, wherein:

the filler orientation direction control shape section has a concave cross section.

3. The printing element substrate supporting member according to claim 1, wherein:

the printing element substrate supporting member is formed by an insert molding method and a side of the supporting section for supporting the printing element substrate is inserted with a filler orientation direction control member extending in the direction along which the ejecting orifices are arranged.

4. The printing element substrate supporting member according to claim 1, wherein:

the printing element substrate supporting member is formed by a two-color molding method and have a filler orientation direction control shape section formed by a first formation step and the other sections including the supporting section, the other sections being formed by a second formation step into the filler orientation direction control shape section.

5. A method for manufacturing a printing element substrate supporting member having a supporting section for supporting a printing element substrate in which ejecting orifices capable of ejecting ink are arranged by injecting resin material including fibrous filler into a cavity of a forming die, wherein:

a direction along which the resin material flowing into a region forming the supporting section in the cavity of the forming die flows is limited to the direction along which the plurality of ejecting orifices are arranged.

6. The manufacture method of the printing element substrate supporting member according to claim 5, wherein:

the forming die has a protruded stripe section extending in the direction along which the ejecting orifices are arranged and a control section opposed to both side faces of the protruded stripe section with a fixed interval and the region between the control section and the protruded stripe section is filled with the resin material from the one end to the other end.

7. The manufacture method of the printing element substrate supporting member according to claim 5, wherein:

the forming die has the protruded stripe section extending in the direction along which the ejecting orifices are arranged, each of filler orientation direction control members is disposed opposite to respective side faces of the protruded stripe section with a fixed interval, and the resin material flows in the region between the filler orientation direction control member and the protruded stripe section from the one end to the other end to fill the region to form the filler orientation direction control member by an insert molding.

8. The manufacture method of the printing element substrate supporting member according to claim 5, wherein:

the method including:

a first formation step for using a first forming die to form a pair of filler orientation direction control sections extending in the direction along which the ejecting orifices are arranged; and a second formation step for disposing a second forming die between the filler orientation direction control sections formed by the first formation step, the second forming die having a protruded stripe section extending in the direction along which the ejecting orifices are arranged, and filling a resin material including fibrous filler into a region formed between the second forming die and a molded component formed by the first formation step, wherein the second formation step fills resin material including fibrous filler into a region between the molded component formed by the first formation step and the protruded stripe section by flowing the resin material from the one end to the other end.

9. An ink jet printing head, wherein:

a printing element substrate in which ejecting orifices capable of ejecting ink are arranged is supported by the printing element substrate supporting member according to claim 1.

* * * * *